US007870702B2

(12) United States Patent
McKay

(10) Patent No.: US 7,870,702 B2
(45) Date of Patent: Jan. 18, 2011

(54) CONCRETE REINFORCEMENT SUPPORT CHAIR

(76) Inventor: Gary Dan McKay, 7802 Belcrest Dr., Frisco, TX (US) 75034

( * ) Notice: Subject to any disclaimer, the term of this patent is extended or adjusted under 35 U.S.C. 154(b) by 496 days.

(21) Appl. No.: 12/022,143

(22) Filed: Jan. 29, 2008

(65) Prior Publication Data

US 2008/0178554 A1 Jul. 31, 2008

Related U.S. Application Data

(60) Provisional application No. 60/887,080, filed on Jan. 29, 2007.

(51) Int. Cl.
*E04C 5/16* (2006.01)

(52) U.S. Cl. ..... 52/684; 52/687; 52/681; 52/682; 248/346.03

(58) Field of Classification Search ..... 52/677, 52/680, 681, 682, 684–687, 689; D25/199; D8/354, 380, 349, 384; 248/346.03, 346.3, 248/370, 440.1, 346.04, 163.1
See application file for complete search history.

(56) References Cited

U.S. PATENT DOCUMENTS

| | | | | |
|---|---|---|---|---|
| 3,338,018 | A | 8/1967 | Mess, Jr. | |
| 3,673,753 | A * | 7/1972 | Anderson | 52/685 |
| 4,498,270 | A * | 2/1985 | Ilukowicz | 52/685 |
| 4,598,523 | A | 7/1986 | Tolliver | |
| 4,655,023 | A * | 4/1987 | Yung | 52/685 |
| 4,682,461 | A * | 7/1987 | Sizemore | 52/689 |
| 4,835,933 | A | 6/1989 | Yung | |
| 5,400,562 | A * | 3/1995 | Bahr | 52/684 |
| 5,555,693 | A | 9/1996 | Sorkin | |
| 5,893,252 | A * | 4/1999 | Hardy et al. | 52/685 |
| 6,112,494 | A | 9/2000 | Hardy, Jr. et al. | |
| 6,276,108 | B1 * | 8/2001 | Padrun | 52/684 |
| 6,282,860 | B1 | 9/2001 | Ramirez | |
| 6,557,317 | B2 | 5/2003 | Sorkin | |
| 6,663,316 | B1 | 12/2003 | Harris | |
| 6,684,594 | B1 | 2/2004 | Sorkin | |
| 6,684,595 | B1 | 2/2004 | Sorkin | |
| 6,837,017 | B2 * | 1/2005 | Hardy et al. | 52/685 |
| 7,237,367 | B1 | 7/2007 | Sorkin | |
| D548,053 | S * | 8/2007 | Erickson et al. | D8/354 |
| 7,404,691 | B2 * | 7/2008 | Bennett et al. | 404/134 |
| 7,451,580 | B2 * | 11/2008 | Kelly et al. | 52/687 |
| 7,506,482 | B2 * | 3/2009 | Sorkin | 52/685 |
| 2005/0210816 | A1 * | 9/2005 | Kelly et al. | 52/677 |

* cited by examiner

*Primary Examiner*—Richard E Chilcot, Jr.
*Assistant Examiner*—Alp Akbasli
(74) *Attorney, Agent, or Firm*—Chalker Flores, LLP; Daniel J. Chalker; Edwin S. Flores

(57) ABSTRACT

An apparatus ("chair") for supporting one or more reinforcement bars or post-tension cables ("bars/cables") in a concrete structure includes a base member having a centered opening, a pair of opposing first leg members extending upward from the base member at a first angle, a pair of opposing second leg members extending upward from the base member at a second angle, and a strap-shaped locking cradle. The strap-shaped locking cradle includes an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed.

19 Claims, 5 Drawing Sheets

CONCRETE REINFORCEMENT SUPPORT CHAIR

PRIORITY CLAIM AND CROSS-REFERENCE TO RELATED APPLICATIONS

This patent application is a non-provisional application of U.S. provisional patent application Ser. No. 60/887,080 filed on Jan. 29, 2007 and entitled "Concrete Reinforcement Support Chair" which is hereby incorporated by reference in its entirety.

FIELD OF THE INVENTION

The present invention relates generally to the field of construction and, more particularly, to a concrete reinforcement support chair.

BACKGROUND OF THE INVENTION

The main function of concrete reinforcement support chairs, commonly referred to as chairs, is to hold tension cables and reinforcement bars/rods ("rebar") within concrete structures, such as roadways, highways, runways, floors, building walls, retaining walls, foundations and flat work. Wire ties have long been used to connect the chairs to the cables or rebar. Extra labor time and expense is necessary to install the ties by hand. In addition, chairs are often overlooked or skipped during the tying process.

More recently, chairs have been developed that do not require the use of separate ties, but such chairs are securely affixed to the cables or rebar. As a result, these chairs are susceptible to movement when the cables or rebar are being laid or tensioned, or when the concrete is poured. The resulting movement can affect the structural integrity of the concrete structure. Moreover, these chairs do not allow for opening or reclosing the fasteners without great difficulty or a high probability of damage to the chair. As a result, such chairs do not allow for relocation or adjustment. Moreover, some of these chairs also have multiple parts that increase the complexity and cost of the installation.

Another problem occurs when liquid concrete flows into a form. The force of the concrete displaces plastic chair supports out of position to float freely within the concrete matrix, or causes them to rotate around and upward on the cable, leaving them sticking out of the finished concrete. When the flow of concrete knocks over chairs which are tied to cables, the cables are stretched and pushed out of the engineered pattern. Yet another problem occurs when moisture barriers of polyurethane, or similar materials, are installed beneath concrete. In such installations, there is a tendency for the sheets of barrier material to blowout of place in windy conditions. This can also cause movement or rotation of the chairs. Additionally, air pockets occur between the ground and the barrier material when concrete is poured into place, creating thin, weakened areas of concrete which cause potential structural problems. Although some chairs have been designed with small projections on the feet/base to increase friction, such projections are not long enough to adequately solve these problems. Moreover, the installer must select chairs with projections or without projections—the chairs are not configurable in the field.

As a result, there is a need for a chair that is inexpensive to manufacture, easy to install and allows for longitudinal movement of the cables or bars.

SUMMARY OF THE INVENTION

The present invention provides a chair that is inexpensive to manufacture, easy to install and allows for longitudinal movement of the cables or bars. The present invention provides a one-piece mold-injected concrete reinforcement support chair is made of plastic-type materials and designed to support concrete reinforcement materials within the middle of a concrete slab. In various embodiments, the present invention provides a top-over slotted tab and hook fastener and/or a snap-off spike. These features, when combined with each other and with other improved design changes in the body of the chair, address problems encountered with use of currently marketed chairs and problems that have come about in recent years with increased use of post-tension cable systems in concrete foundations. The present invention can also be used within many concrete structures, such as roadways, highways, runways, floors, building walls, retaining walls, foundations and flat work.

In one embodiment, the present invention provides an apparatus ("chair") for supporting one or more reinforcement bars or post-tension cables ("bars/cables") in a concrete structure. The apparatus includes a base member having a centered opening, a pair of opposing first leg members extending upward from the base member at a first angle, a pair of opposing second leg members extending upward from the base member at a second angle, and a strap-shaped locking cradle. The strap-shaped locking cradle includes an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed.

In another embodiment, the present invention provides a chair for supporting one or more bars/cables in a concrete structure. The chair includes a base member having a centered opening, a pair of opposing first leg members extending upward from the base member at a first angle oriented perpendicular to the longitudinal axis of the bars/cables, a pair of opposing second leg members extending upward from the base member at a second angle oriented with a longitudinal axis of the bars/cables, a strap-shaped locking cradle and a spike. The strap-shaped locking cradle includes an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed, and wherein the fastener can be opened and closed without damaging the fastener. The spike extends downward from the strap-shaped locking cradle through the centered opening to at least one inch below the based member, wherein the spike has one or more break point notches between the strap-shaped locking cradle and the centered opening that allow the spike to be broken off at or above the base member.

In yet another embodiment, the present invention provides a chair for supporting one or more bars/cables in a concrete structure. The chair includes a substantially flat base member having a centered opening, a pair of opposing first I-beam shaped leg members extending upward from the base member at a first angle oriented perpendicular to the longitudinal axis of the bars/cables, a pair of opposing second I-beam shaped leg members extending upward from the base member at a second angle oriented with a longitudinal axis of the bars/cables, a strap-shaped locking cradle and an I-beam shaped spike. The strap-shaped locking cradle includes an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed, and wherein the fastener can be opened and closed without damaging the fastener. The I-beam shaped spike extends downward from the strap-shaped locking cradle through the centered opening to at least one inch below the based member, wherein the spike has one or more break point notches between the strap-shaped locking cradle and the centered opening that allow the spike to be broken off at or above the base member.

Another embodiment of the present invention provides a concrete structure, such as a roadway, highway, runway, floor, building wall, retaining wall, foundation or flat work, that includes a lattice of reinforcement bars or post-tension cables, a set of chairs supporting the lattice of bars/cables, and concrete substantially encapsulating the lattice of bars/cables and the set of chairs. Each chair includes a base member having a centered opening, a pair of opposing first leg members extending upward from the base member at a first angle, a pair of opposing second leg members extending upward from the base member at a second angle, and a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed.

The present invention is described in detail below with reference to the accompanying drawings.

BRIEF DESCRIPTION OF THE DRAWINGS

The above and further advantages of the invention may be better understood by referring to the following description in conjunction with the accompanying drawings, in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The present invention provides a chair that is inexpensive to manufacture, easy to install and allows for longitudinal movement of the cables or bars. The present invention provides a one-piece mold-injected concrete reinforcement support chair is made of plastic-type materials and designed to support concrete reinforcement materials within the middle of a concrete slab. In various embodiments, the present invention provides a top-over slotted tab and hook fastener and/or a snap-off spike. These features, when combined with each other and with other improved design changes in the body of the chair, address problems encountered with use of currently marketed chairs and problems that have come about in recent years with increased use of post-tension cable systems in concrete foundations. The present invention can also be used within many concrete structures, such as roadways, highways, runways, floors, building walls, retaining walls, foundations and flat work.

Figure 1:
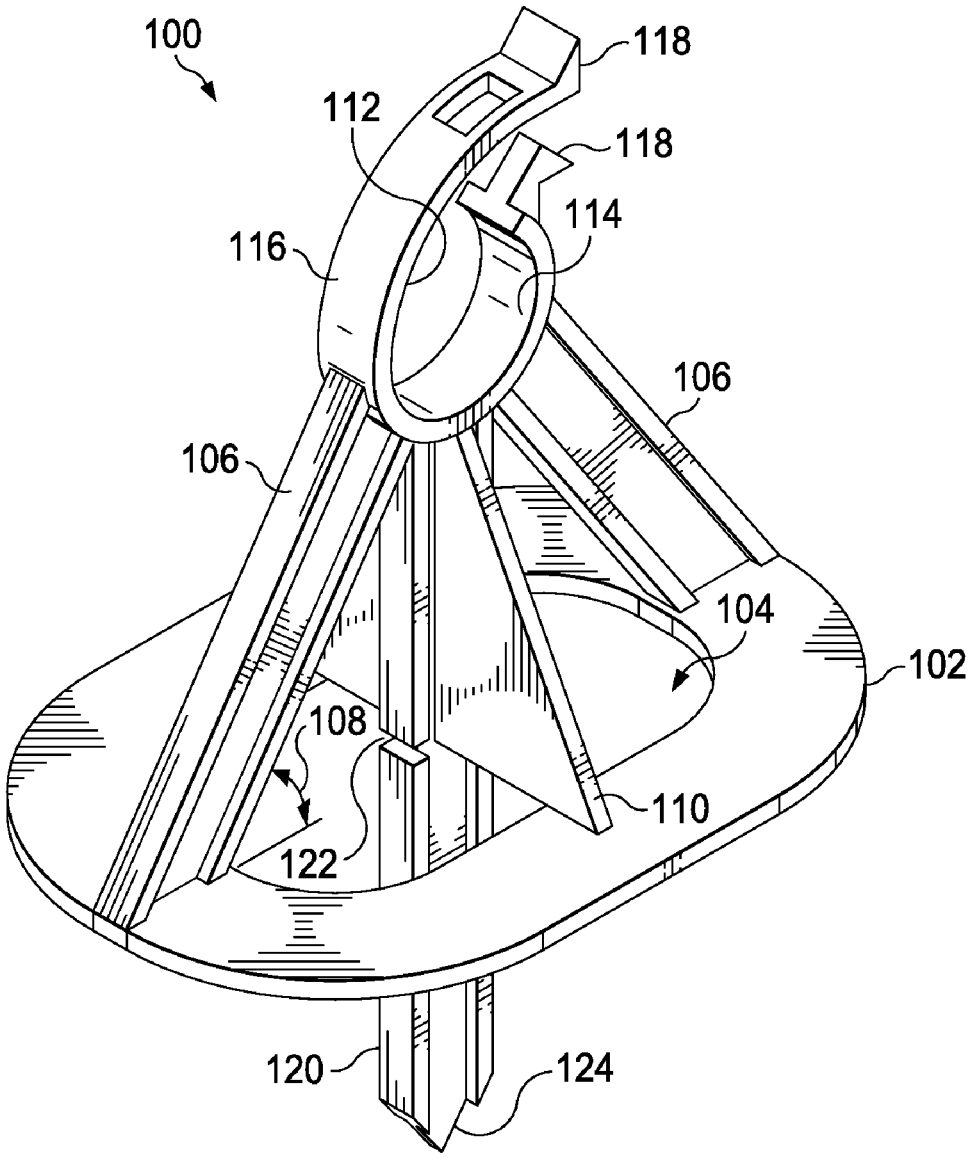
FIG. 1 is a isometric view of a chair in accordance with one embodiment of the present invention.
Figure 2:
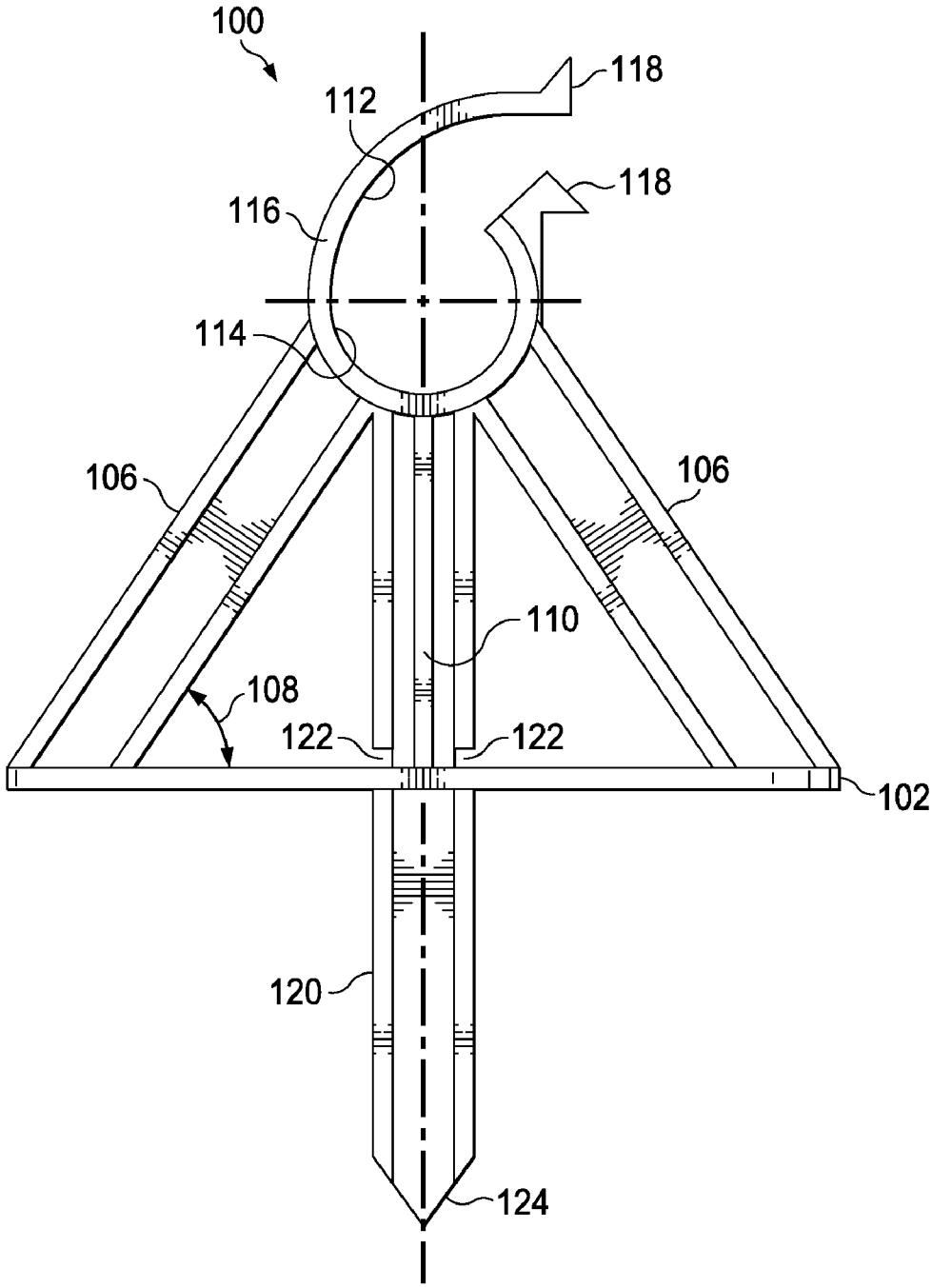
FIG. 2 is a side view of the chair shown in FIG. 1.
Figure 3:
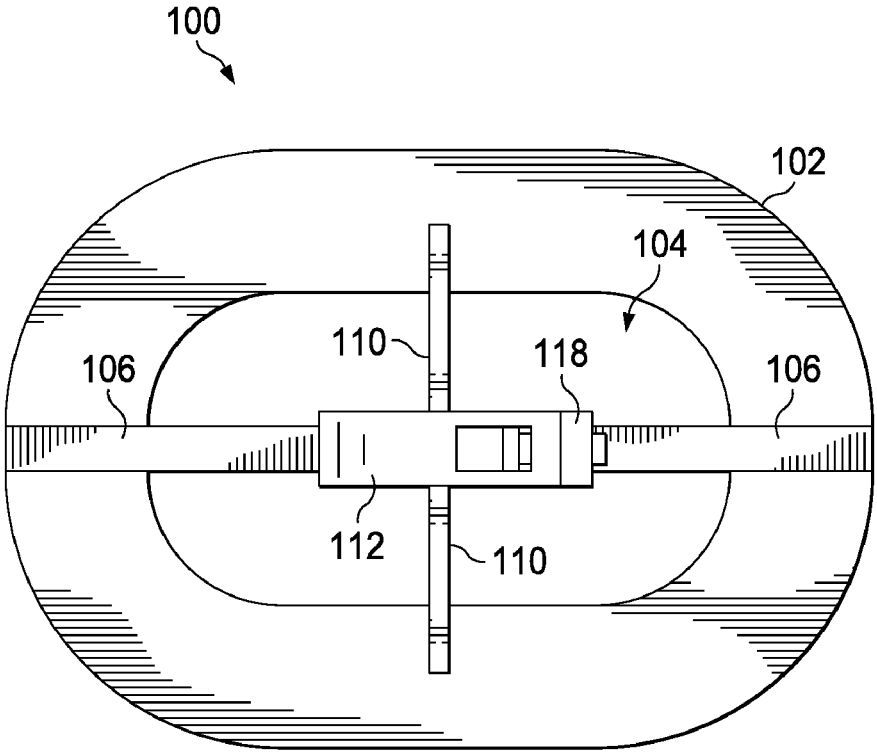
FIG. 3 is a top view of the chair shown in FIG. 1.

Now referring to FIGS. 1, 2 and 3, various views of a chair 100 in accordance with one embodiment of the present invention are shown. The chair 100 includes a base member 102 having a centered opening 104, a pair of opposing first leg members 106 extending upward from the base member 102 at a first angle 108, a pair of opposing second leg members 110 extending upward from the base member 102 at a second angle, and a strap-shaped locking cradle 112. The base member 102 can be circular, round, oval, elliptical, triangular, rectangular, hexagonal or other polygonal shape. Moreover, the base member 102 can be substantially flat or rounded. For example, a flat, elliptically shaped base member 102, which sits at ground level, the longer side of which runs perpendicular to the direction of inserted post-tension cables and rebar allows for lengthwise movement of the cables while other chairs are being installed without disturbing the placement of other placed chairs. The first and second leg members (106 and 110) can be I-beam shaped, circular, square or triangular. Note that I-beam shaped leg members (106 and 110) can be used to provide extra strength against the force of liquid concrete. The first and second angle can be the same or different depending on the specific size and application of the chair. As shown, the first leg members are oriented perpendicular to the longitudinal axis of the bars/cables; and the second leg members are oriented with a longitudinal axis of the bars/cables.

The strap-shaped locking cradle 112 includes an arc-shaped receiving portion 114 attached to the first and second leg members (106 and 110), a flexible portion 116 suitable for firmly wrapping over the bars/cables and a fastener 118 to affix the flexible portion 116 to the arc-shaped receiving portion 114 or one of the first leg members 106 such that transverse and vertical movement of the bars/cables is limited and longitudinal movement of the bars/cables is allowed. Note that the transverse and vertical movement of the bars/cables can also be prevented. The fastener 112 can be a slotted tab and hook fastener (shown), a hook and notch fastener, a tap and notch fastener, a loop and hook fastener (e.g., Velcro®) or a reusable snap-type fastener. Moreover, the fastener 112 can be adjustable to accommodate different sized bars/cables. Furthermore, the fastener 112 can be opened and closed without damaging the fastener to accommodate relocation or adjustments to cables and rebar. The strap-shaped locking cradle 112 can support two or more parallel bars/cables.

As shown, the chair 100 also includes a spike 120 extending downward from the strap-shaped locking cradle 112 through the centered opening 104. The spike 120 includes one or more break point notches 122 between the strap-shaped locking cradle 112 and the centered opening 104 that allow the spike 120 to be broken off at or above the base member 102 when the spike 120 is not needed or not allowed. The spike 120 preferably extends at least one inch below the base member 102. Other lengths can be used, such as one and one-half inches or two inches. The spike 120 when inserted into the ground provides give added stability to the chair's placement. This may occur when plumbing pipes or utility lines are already installed or when concrete will be poured over old existing concrete, asphalt, or other previously-installed materials. The spike 120 decreases the occurrence of cable-bowing by staking the chairs 100 in place to the ground. The spike 120 provides the additional benefits of holding moisture barrier materials in place, allowing air to escape through the spike penetration hole from between the barrier and the ground, and keeping cables in place according to engineered plans. The spike 120 can be I-beam shaped, circular, square or triangular. Moreover, the spike 120 can have a tip 124 that is pointed or arrow-shaped. The spike 120 can also be integrated into the second pair of leg members 110 such that the second pair of leg members 110 can be thinner and do not require the added strength of an I-beam shape (See FIGS. 4 and 5).

The chair 100 can be manufactured using a mold injection process. Accordingly, the chair 100 can be formed of nylon, polypropylene, polyethylene or moldable composites. Other suitable materials may also be used. The chair 100 can be modified at the time of manufacture for use in a thicker slab by adjusting the total height of the chair; the length, diameter or shape of its support legs; the capacity of the fastener; the diameter or length of the spike; and/or the size of any of its components. The height of the support legs and the size or capacity of the fastener can be varied during manufacturing to accommodate variable post-tension cable and rebar sizes. The chair 100 is best used by determining and choosing the best size necessary as established by generally accepted engineering principles of concrete design and construction, inserting and locking rebar and post-tension cables in place into the top-over slotted tab-and-hook fastener, and inserting the spike into the ground. This will ensure both reinforcement materials and support chair stay in place during placement of concrete. Alternative forms of the product may be manufactured by changing or altering individual features. For example, the spike may be made in round cylindrical triangular shapes. It may be made in various lengths and widths. It might be given an arrow-shaped tip. It might be made without the snap-off feature. The elliptical shape of the base might be changed to a circular, round, oval, triangular, rectangular, or other geometrical shape, but it will achieve optimal results by using the elliptical shape as designed. The base may be changed from a flat design to one of a more round one. The I-beam support legs may be made in round or square shapes, without the I-beam construction. I-beam construction gives the optimum strength and stability for the industry in which the unit will be used. The top-over slotted tab-and-hook fastener might be given additional stop notches and/or holes to handle different support material sizes. The seat where the cable and/or rebar sit can be enlarged to accommodate two same-direction pieces of rebar as required by engineered drawings.

Figure 4:
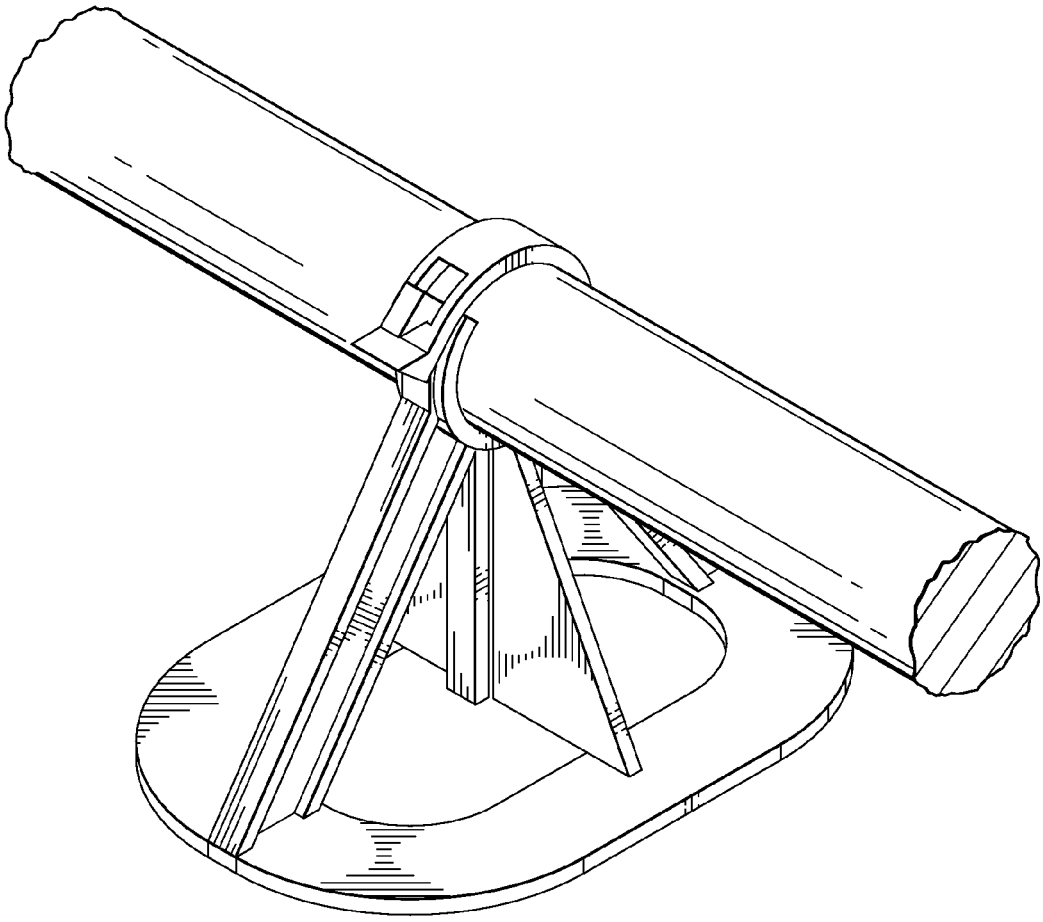
FIG. 4 is an illustration of a chair in accordance with one embodiment of the present invention connected to a cable.
Figure 5:
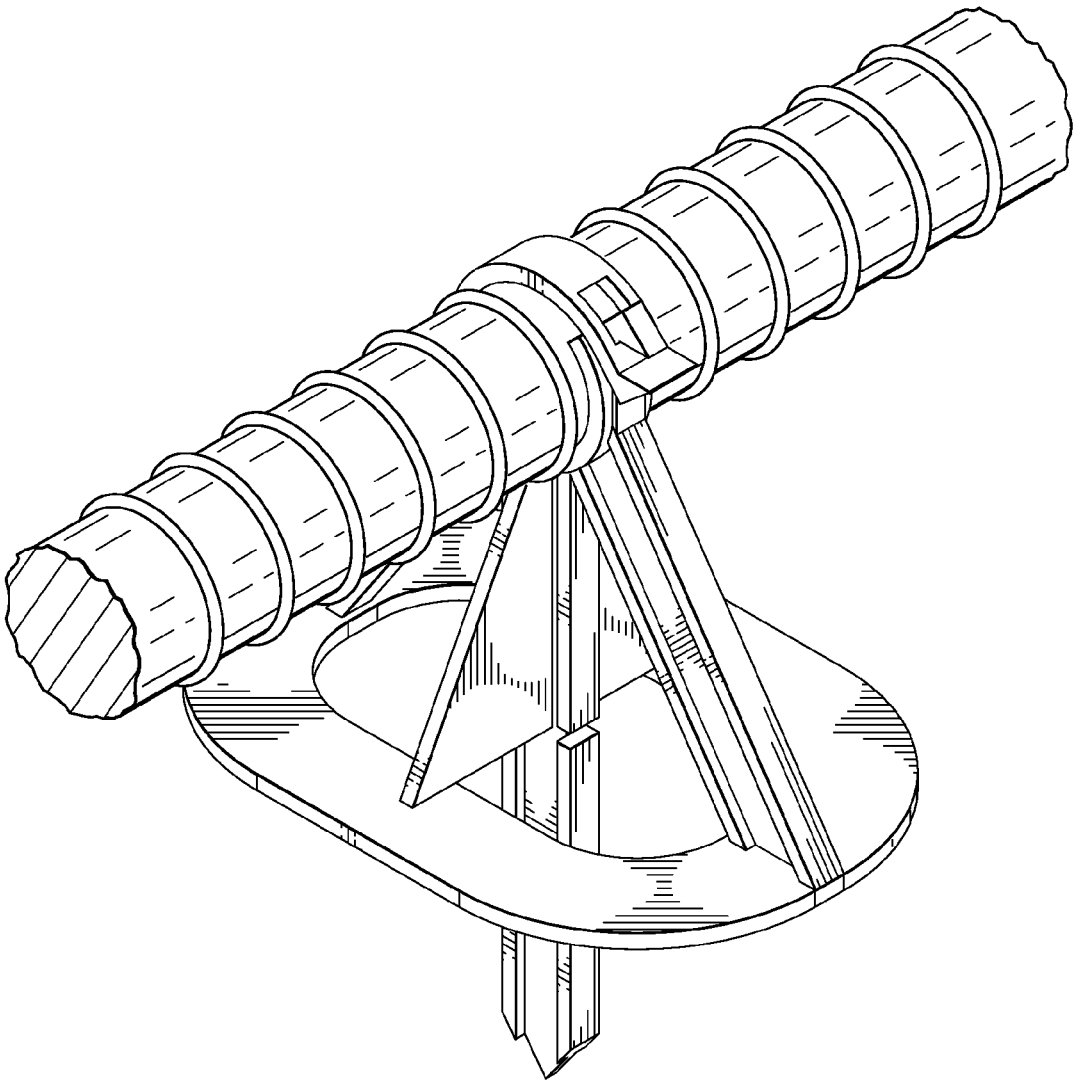
FIG. 5 is an illustration of a chair in accordance with one embodiment of the present invention connected to a rebar.

Some examples of the chair 100 are shown in FIGS. 4 and 5. FIG. 4 illustrates of a chair 100 connected to a cable. FIG. 5 illustrates of a chair 100 connected to a rebar. The other described embodiments of the present invention are derived by using specific design alternatives described in reference to FIGS. 1-3. Moreover, these embodiments can be used in a concrete structure, such as a roadway, highway, runway, floor, building wall, retaining wall, foundation or flat work. The concrete structure includes a lattice of reinforcement bars or post-tension cables, a set of chairs supporting the lattice of bars/cables, and concrete substantially encapsulating the lattice of bars/cables and the set of chairs. Each chair includes a base member having a centered opening, a pair of opposing first leg members extending upward from the base member at a first angle, a pair of opposing second leg members extending upward from the base member at a second angle, and a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed.

Although preferred embodiments of the present invention have been described in detail, it will be understood by those skilled in the art that various modifications can be made therein without departing from the spirit and scope of the invention as set forth in the appended claims.

What is claimed is:

1. An apparatus for supporting one or more reinforcement bars or post-tension cables ("bars/cables") in a concrete structure, the apparatus comprising:

a base member having a centered opening;

a pair of opposing first leg members extending upward from the base member at a first angle;

a pair of opposing second leg members extending upward from the base member at a second angle;

a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed; and a spike extending downward from the strap-shaped locking cradle through the centered opening.

2. The apparatus as recited in claim 1 wherein the transverse and vertical movement of the bars/cables is prevented.

3. The apparatus as recited in claim 1 wherein:

the first and second angle are the same or the first and second angle are different;

the first leg members are oriented perpendicular to the longitudinal axis of the bars/cables; and the second leg members are oriented with a longitudinal axis of the bars/cables.

4. The apparatus as recited in claim 1 wherein the fastener comprises a slotted tab and hook fastener, a hook and notch fastener, a tap and notch fastener, a loop and hook fastener or a reusable snap-type fastener.

5. The apparatus as recited in claim 1 wherein the fastener is adjustable to accommodate different sized bars/cables.

6. The apparatus as recited in claim 1 wherein the fastener can be opened and closed without damaging the fastener.

7. The apparatus as recited in claim 1 wherein the spike has one or more break point notches between the strap-shaped locking cradle and the centered opening that allow the spike to be broken off at or above the base member.

8. The apparatus as recited in claim 1 wherein the spike extends at least one inch below the base member and the spike is integrated into the second pair of leg members.

9. The apparatus as recited in claim 1 wherein:

the base member is circular, round, oval, elliptical, triangular, rectangular, hexagonal or other polygonal shape; and the first and second leg members are I-beam shaped, circular, square or triangular.

10. The apparatus as recited in claim 1 wherein the base member is substantially flat or rounded.

11. The apparatus as recited in claim 1 wherein:

the spike is I-beam shaped, circular, square or triangular; and the spike has a tip that is pointed or arrow-shaped.

12. The apparatus as recited in claim 1 wherein the strap-shaped locking cradle supports two or more parallel bars/cables.

13. The apparatus as recited in claim 1 wherein the apparatus is manufactured using a mold injection process.

14. The apparatus as recited in claim 1 wherein the apparatus is formed of a material selected from the group consisting of nylon, polypropylene, polyethylene and moldable composites.

15. An apparatus for supporting one or more reinforcement bars or post-tension cables ("bars/cables") in a concrete structure, the apparatus comprising:

a base member having a centered opening;

a pair of opposing first leg members extending upward from the base member at a first angle oriented perpendicular to the longitudinal axis of the bars/cables;

a pair of opposing second leg members extending upward from the base member at a second angle oriented with a longitudinal axis of the bars/cables;

a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed, and wherein the fastener can be opened and closed without damaging the fastener; and a spike extending downward from the strap-shaped locking cradle through the centered opening to at least one inch below the based member, wherein the spike has one or more break point notches between the strap-shaped locking cradle and the centered opening that allow the spike to be broken off at or above the base member.

16. The apparatus as recited in claim 15 wherein the fastener comprises a slotted tab and hook fastener, a hook and notch fastener, a tap and notch fastener, a loop and hook fastener or a reusable snap-type fastener, and the fastener is adjustable to accommodate different sized bars/cables.

17. An apparatus for supporting one or more reinforcement bars or post-tension cables ("bars/cables") in a concrete structure, the apparatus comprising:

a substantially flat base member having a centered opening;

a pair of opposing first I-beam shaped leg members extending upward from the base member at a first angle oriented perpendicular to the longitudinal axis of the bars/cables;

a pair of opposing second I-beam shaped leg members extending upward from the base member at a second angle oriented with a longitudinal axis of the bars/cables;

a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed, and wherein the fastener can be opened and closed without damaging the fastener; and an I-beam shaped spike extending downward from the strap-shaped locking cradle through the centered opening to at least one inch below the based member, wherein the spike has one or more break point notches between the strap-shaped locking cradle and the centered opening that allow the spike to be broken off at or above the base member.

18. The apparatus as recited in claim 17 wherein the fastener comprises a slotted tab and hook fastener, a hook and notch fastener, a tap and notch fastener, a loop and hook fastener or a reusable snap-type fastener, and the fastener is adjustable to accommodate different sized bars/cables.

19. A concrete structure comprising:

a lattice of reinforcement bars or post-tension cables ("bars/cables");

a set of chairs supporting the lattice of bars/cables, wherein each chair comprises a base member having a centered opening, a pair of opposing first leg members extending upward from the base member at a first angle, a pair of opposing second leg members extending upward from the base member at a second angle, and a strap-shaped locking cradle comprising an arc-shaped receiving portion attached to the first and second leg members, a flexible portion suitable for wrapping over the bars/cables and a fastener to affix the flexible portion to the arc-shaped receiving portion or one of the first leg members such that transverse and vertical movement of the bars/cables is limited and longitudinal movement of the bars/cables is allowed;

concrete substantially encapsulating the lattice of bars/cables and the set of chairs, and a spike extending downward from the strap-shaped locking cradle through the centered opening.

* * * * *

UNITED STATES PATENT AND TRADEMARK OFFICE

CERTIFICATE OF CORRECTION

PATENT NO. : 7,870,702 B2
APPLICATION NO. : 12/022143
DATED : January 18, 2011
INVENTOR(S) : Gary Dan McKay It is certified that error appears in the above-identified patent and that said Letters Patent is hereby corrected as shown below:

Col. 2, line 11
Replace “chair is made” with --chair that is made--

Col. 2, line 59
Replace “the based member” with --the base member--

Col. 3, line 16-17
Replace “the based member” with --the base member--

Col. 7, line 40
Replace “the based member” with --the base member--

Col. 8, line 21
Replace “the based member” with --the base member--

Signed and Sealed this
Fourth Day of October, 2011

David J. Kappos

David J. Kappos
*Director of the United States Patent and Trademark Office*